US006806801B2

(12) United States Patent
Kadoya et al.

(10) Patent No.: US 6,806,801 B2
(45) Date of Patent: Oct. 19, 2004

(54) HIGH FREQUENCY RELAY

(75) Inventors: Kenji Kadoya, Matsuzaka (JP); Kazuyoshi Tsuka, Mie (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/926,825

(22) PCT Filed: Apr. 27, 2001

(86) PCT No.: PCT/JP01/03671

§ 371 (c)(1),
(2), (4) Date: Apr. 3, 2002

(87) PCT Pub. No.: WO01/84577

PCT Pub. Date: Nov. 8, 2001

(65) Prior Publication Data

US 2002/0121950 A1 Sep. 5, 2002

(30) Foreign Application Priority Data

Apr. 28, 2000 (JP) ..... 2000-131133
May 31, 2000 (JP) ..... 2000-163516

(51) Int. Cl.[7] ..... H01H 51/22
(52) U.S. Cl. ..... 335/78; 335/80; 335/83
(58) Field of Search ..... 335/78, 80, 83

(56) References Cited

U.S. PATENT DOCUMENTS 4,626,812 A * 12/1986 Nakanishi et al. ..... 335/132
4,658,226 A * 4/1987 Maenishi et al. ..... 335/127
4,831,348 A * 5/1989 Agatahama et al. ..... 335/80
4,993,787 A * 2/1991 Tanaka et al. ..... 335/78
5,994,986 A * 11/1999 Takahashi ..... 335/78
6,329,891 B1 * 12/2001 Hayashi et al. ..... 335/4

FOREIGN PATENT DOCUMENTS

JP 55115233 9/1980
JP 63-35051 7/1988
JP 1-59691 12/1989
JP 2-39059 9/1990
JP 3-28636 3/1991
JP 6-12957 1/1994
JP 6-283884 10/1994
JP 7-23877 5/1995
JP 1129650 8/1999
JP 1130729 12/1999

OTHER PUBLICATIONS

English Language Abstract of JP 6–12957.
English Language Abstract of JP 55–115233.
English Language Abstract of JP 6–283884.
English Language Abstract of JP 10–13077.
English Language Abstract of JP 2–39059.
English Language Abstract of JP 11–340729.
English Language Abstract of JP 11–219650.
English Language Abstract of JP 3–28636.
English Language Abstract of JP 63–35051.
English Language Abstract of JP 1–59691.
English Language Abstract of JP 6–12957.

* cited by examiner

*Primary Examiner*—Patricia Nguyen
(74) *Attorney, Agent, or Firm*—Greenblum & Bernstein, P.L.C.

(57) ABSTRACT

A high frequency relay has a mounting surface to be mounted on an external element and includes an electromagnet having an iron core and a coil wound around the iron core, stationary terminals to be connected to the external element, contacts formed to be generally flat and having respective contact surfaces to be brought into contact with or separated from the stationary terminals, an armature attracted to or repelled from the iron core according to energization of the coil to obtain a driving force for driving the contacts, and a pair of shielding members made of a metallic material for supporting the contacts in an insulated state so that the contact surfaces extend generally parallel to the mounting surface. The pair of shielding members are provided to shield contact portions between the contacts and the stationary terminals and sandwich the contact in a direction perpendicular to the mounting surface.

14 Claims, 11 Drawing Sheets

HIGH FREQUENCY RELAY

TECHNICAL FIELD

The present invention relates to a high frequency relay for allowing or blocking high frequency signals to pass therethrough.

BACKGROUND ART

A conventional high frequency relay is disclosed in, for example, Japanese Patent Publication No. 7-23877. As shown in FIG. 16, this relay includes an electromagnet C having a coil A wound around an iron core B, stationary terminals D to be connected to the outside, contacts (movable contacts) E driven to move toward or away from the stationary terminals D, and a movable iron piece (armature) F to be attracted or repelled by the iron core B according to energization of the coil A that creates a driving force for driving the contact E.

As shown in FIG. 17, this high frequency relay has a mounting surface G to be mounted on a printed wiring board (outside) X. When this is mounted on the printed wiring board X, the stationary terminals D extend through the printed wiring board X and protrude beyond a rear surface thereof. The high frequency relay is fixed to the printed wiring board X by soldering the root of such protruding portion.

In the conventional high frequency relay referred to above, when it is mounted on the printed wiring board X, the stationary terminals D extend through the printed wiring board X and are fixed thereto so that the stationary terminals D, which constitute transmission paths for high frequency signals, protrude from the rear surface. It is, therefore, inevitably impossible to shield those portions that extend through or protrude from the printed wiring board X and, hence, the shielding properties with respect to the transmission paths for the high frequency signals are not so high.

The present invention has been developed to overcome the above-described disadvantages.

It is accordingly an objective of the present invention to provide a high frequency relay having high shielding properties with respect to the transmission paths for the high frequency signals and also having a simple structure with a reduced number of component parts.

DISCLOSURE OF THE INVENTION

In accomplishing the above objective, a high frequency relay according to the present invention has a mounting surface to be mounted on an external element and is characterized by including an electromagnet having an iron core and a coil wound around the iron core, stationary terminals to be connected to the external element, contacts formed to be generally flat and having respective contact surfaces to be brought into contact with or separated from the stationary terminals, an armature attracted to or repelled from the iron core according to energization of the coil to obtain a driving force for driving the contacts, and a pair of shielding members made of a metallic material for supporting the contacts in an insulated state so that the contact surfaces extend generally parallel to the mounting surface. The pair of shielding members shield contact portions between the contacts and the stationary terminals and sandwich the contacts in a direction perpendicular to the mounting surface.

Compared with the case where the contact portions of the stationary terminals with the contacts extend in a direction perpendicular to the mounting surface and the surfaces of the contacts similarly extend in the same direction, as shown in FIG. 16, the above-described construction can shorten the stationary terminals forming transmission paths for high frequency signals by a length corresponding to the width of the contacts at the contact surfaces, making it possible to enhance the shielding properties with respect to the transmission paths for the high frequency signals.

Furthermore, because the pair of shielding members are provided to sandwich the contacts in a direction perpendicular to the contact surfaces, i.e., in a direction perpendicular to the mounting surface, a plurality of contacts can be juxtaposed with one another over the mounting surface and, hence, the shielding members are not required for every pole and can be used for multi-pole relays. Accordingly, not only can the number of component parts be reduced but the high frequency relay can also be simplified in structure and reduced in size.

The high frequency relay according to the present invention is also characterized in that the stationary terminals have respective outer end portions substantially flush with the mounting surface and, hence, the stationary terminals can be used as the so-called SMD terminals to be soldered to an external surface. Accordingly, compared with conventional relays wherein the stationary terminals extend through a printed wiring board and protrude beyond a rear surface thereof, the stationary terminals forming the transmission paths for the high frequency signals can be shortened, making it possible to enhance the shielding properties with respect to the transmission paths for the high frequency signals.

The high frequency relay according to the present invention is also characterized in that the armature swings with a central portion thereof as a fulcrum when any one of opposite end portions thereof is attracted to or repelled from the iron core, wherein the armature has a first surface confronting the electromagnet and a second surface opposite to the first surface, and also has a drive member secured to the second surface thereof and having a longitudinal length shorter than that of the armature, and wherein a driving force from the armature is transmitted to the contacts via the drive member.

By this construction, the driving force obtained by the armature is transmitted to the positions inwardly of the opposite end portions of the armature via the drive member integrated with the armature. Accordingly, compared with the case where the driving force is transmitted to the positions in the proximity of the magnetic pole portions, the transmitting portions to which the driving force for driving the contacts is transmitted can be positioned close to the stationary terminals. As a result, the contacts can be brought into contact with or separated from the stationary terminals without enlarging the size of the contacts in a direction along the armature, making it possible to further enhance the shielding properties with respect to the transmission paths for the high frequency signals.

The high frequency relay according to the present invention further includes transit members having respective transmitting portions to which the driving force is transmitted. Because the transit members transmit the driving force to positions inwardly of the transmitting portions, the positions to which the driving force is transmitted can be brought closer to the fulcrum for the swinging motion. Accordingly, the length of the contacts can be further reduced and, hence, the shielding properties with respect to the transmission paths for the high frequency signals are high.

Furthermore, in the high frequency relay according to the present invention, the pair of shielding members are joined together by an electrically conductive adhesive. Accordingly, even if a gap is created between both the shielding members due to, for example, a dimensional tolerance, the electrical connection between both the shielding members is ensured, thus enhancing the reliability in shielding effects.

Also, in the high frequency relay according to the present invention, one of the pair of shielding members has insertion holes defined therein into which the contact support members are inserted, and the support members have metallic shielding portions at locations corresponding to the insertion holes. Accordingly, the reliability improves without lowering the shielding properties.

Moreover, because the support members have respective metallic support portions connected to one of the pair of shielding members, the contacts can be shielded at locations supporting the contact support members of an insulating material, enhancing the shielding properties.

Also, because the mounting surface is an external surface of one of the pair of shielding members, they can be grounded without providing any separate earth terminal, making it possible to reduce the number of the component parts and simplify the construction.

Furthermore, because distal ends of the stationary terminals are positioned inside the casing, the shielding effects can be further enhanced.

In addition, the high frequency relay according to the present invention further includes contact support members for supporting the contacts in an insulated state wherein the contact support members support the contacts in a direction substantially parallel to the mounting surface. Accordingly, in the case where the high frequency relay is used as a multi-pole relay, the contact support members are not required for every pole, making it possible to reduce the number of the component parts and simplify the construction.

The pair of shielding members are formed into a desired shape by metal-injection molding. Even if they have a complicated configuration, the metal-injection molding can readily process them and enables precise processing, resulting in a reduction in the size of the high frequency relay.

Also, because the pair of shielding members are joined together by laser welding, the joining can be ensured, providing sufficient shielding properties.

Furthermore, the high frequency relay according to the present invention is characterized in that the normally-closed stationary terminal, the coil terminal, the common stationary terminal, the coil terminal, the normally open stationary terminal, the normally open stationary terminal, the coil terminal, the common stationary terminal, the coil terminal, and the normally-closed stationary terminal are arranged around one of the pair of shielding members in this order.

This construction is advantageous when the high frequency relay is placed on a microstrip structure to constitute an attenuator circuit together with an attenuator element. More specifically, when the normally-closed stationary terminals directly connected to each other, the normally open stationary terminals connected via an attenuator element, and the common stationary terminals are provided by twos, they are arranged around one of the shielding members such that the common stationary terminals are led outwardly between the positions where the normally-closed stationary terminals and the normally open stationary terminals are led outwardly, and the coil terminals connected to the supply lines are led outwardly between the positions where the normally-closed stationary terminals and the common stationary terminals are led outwardly and between the positions where the normally open stationary terminals and the common stationary terminals are led outwardly. Accordingly, connecting lines for connecting the coil terminals and the supply lines do not cross any one of a connecting line for connecting the normally-closed stationary terminals and a connecting line for connecting the common stationary terminals, as viewed from above. Accordingly, the microstrip structure is not required to have any through-holes for a multi-level crossing among the connecting lines and, hence, sufficient impedance matching for the high frequency signals can be obtained.

Also, one of the pair of shielding members is formed into a rectangular configuration, and the normally-closed stationary terminals and the normally open stationary terminals are led out from one side and the opposite side of the one of the pair of shielding members, respectively. Accordingly, the normally-closed stationary terminals and the normally open stationary terminals can be separated, thus enhancing the isolation properties.

Moreover, if the one side and the opposite side are opposite short sides of the one of the pair of shielding members, the normally-closed stationary terminals and the normally open stationary terminals can be sufficiently separated, thus enhancing the isolation properties.

BEST MODE FOR CARRYING OUT THE INVENTION

Figure 1:
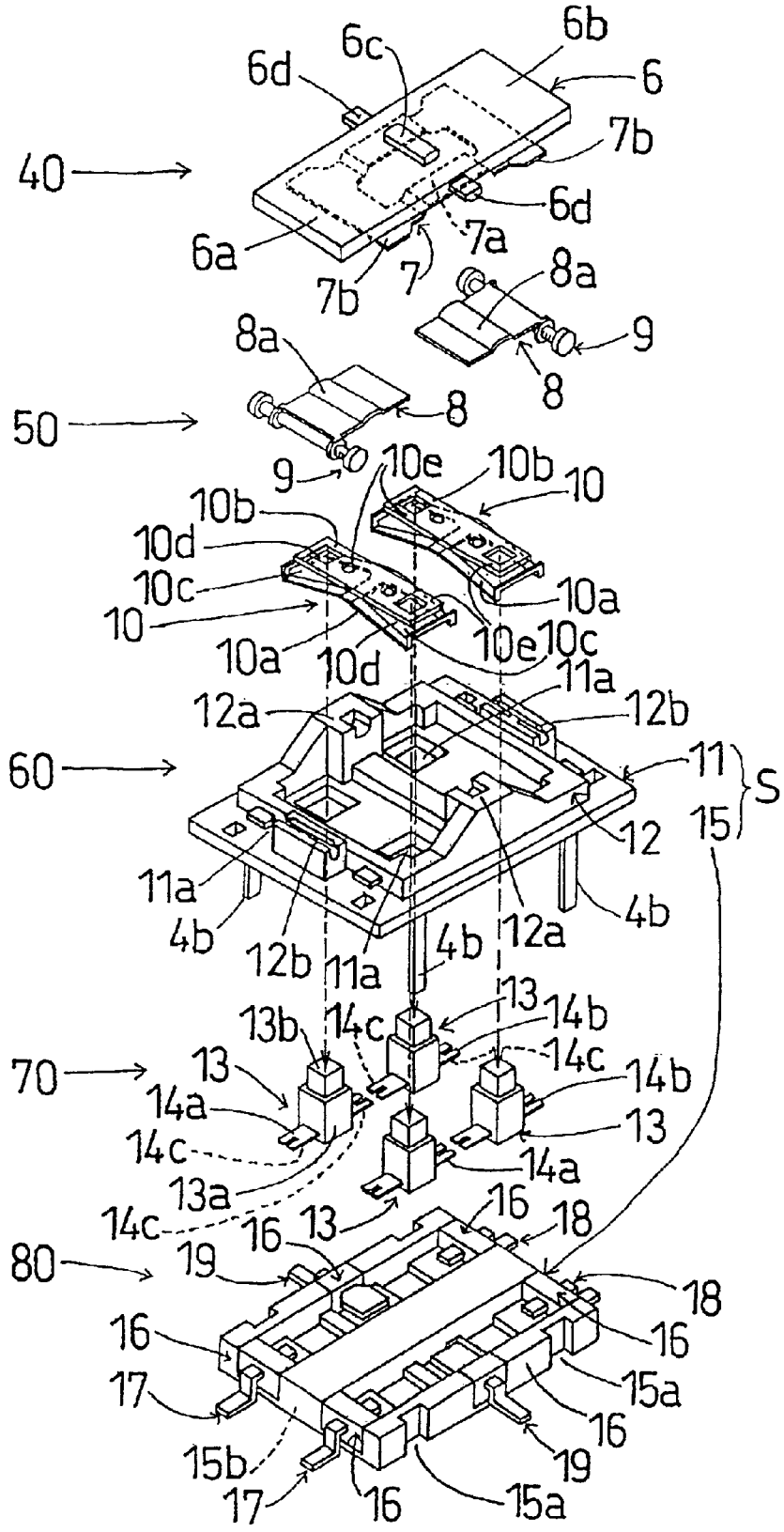
FIG. 1 is an exploded perspective view of a high frequency relay according to a first embodiment of the present invention with a casing and an electromagnet block removed.
Figure 2:
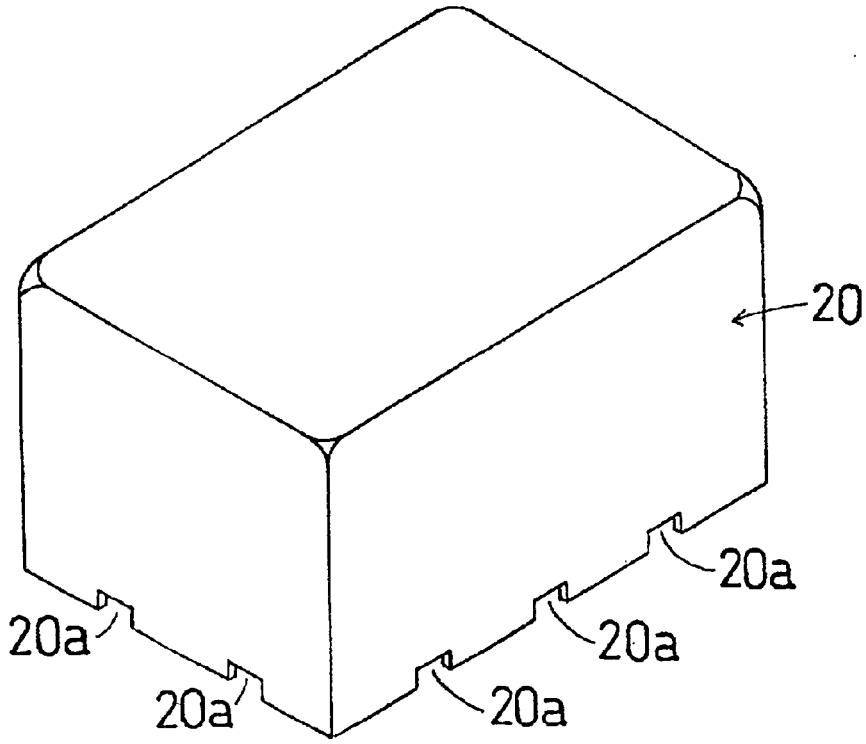
FIG. 2 is a perspective view of a casing attached to the high frequency relay.
Figure 3:
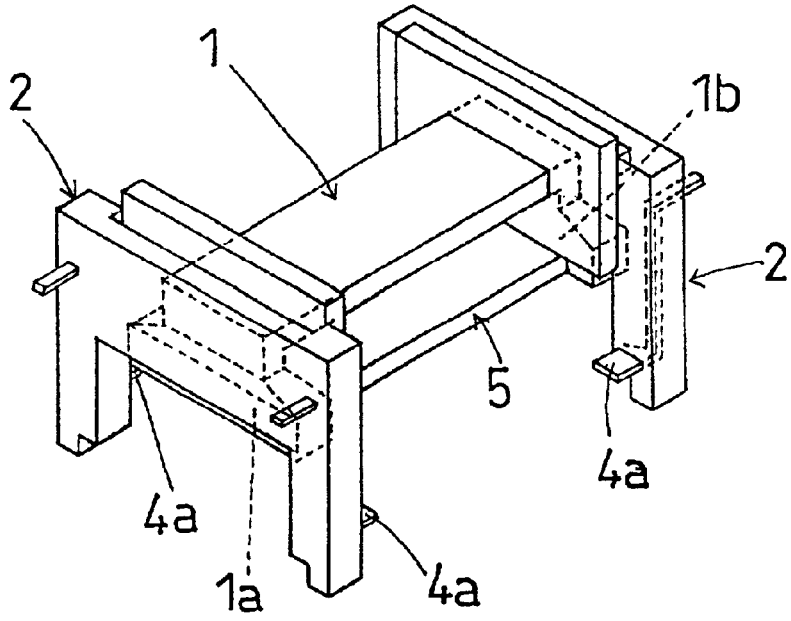
FIG. 3 is a perspective view of an electromagnet attached to the high frequency relay.
Figure 4:
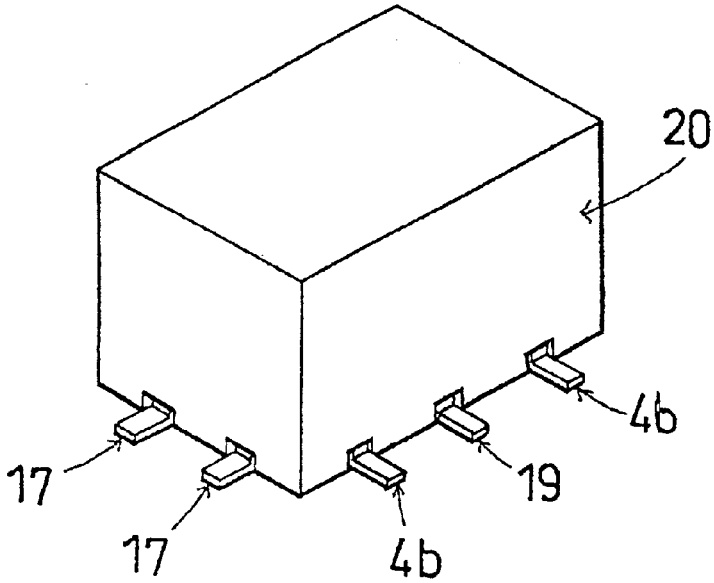
FIG. 4 is a perspective view of the high frequency relay.

A high frequency relay according to a first embodiment of the present invention is explained hereinafter with reference to FIGS. 1 to 5. Coils 3 are omitted in FIG. 3.

1 denotes an iron core made of a magnetic material and formed into a substantially U-shape having two leg portions that act as magnetic pole portions 1*a*, 1*b*. The iron core 1 is provided with a coil or coils 3 wound therearound between opposite end portions 2 integrally molded therewith to constitute an electromagnet 30*a* together with the coil 3. The coil 3 is connected to coil terminals 4*a* integrally molded with the end portions 2.

5 denotes a generally flat permanent magnet that has been magnetized at three points so that S poles are formed in opposite end portions 5*a*, 5*b* and an N pole is formed in a portion offset from the central portion. Because the permanent magnet 5 has been magnetized as having the N pole at the portion offset from the central portion, it provides a mono-stable motion as discussed later. The permanent magnet 5 is welded at the opposite end portions 5*a*, 5*b* to the iron core 1 under the condition in which the opposite end portions 5*a*, 5*b* are located inside the opposite magnetic pole portions 1*a*, 1*b*, respectively. The permanent magnet 5 together with the end portions 2 and the electromagnet 30*a* constitute an electromagnet block 30.

6 denotes an armature made of a magnetic material that is formed into a generally rectangular flat plate so that opposite end portions 6*a*, 6*b* in the longitudinal direction constituting the magnetic pole portions confront the magnetic pole portions 1*a*, 1*b* at the opposite end portions of the iron core 1. The armature 6 includes a convex fulcrum 6*c* formed at the center on one surface thereof and held in contact with the central portion of the permanent magnet 5 for providing a seesaw motion by the attraction or repulsion to or from the magnetic pole portions 1*a*, 1*b* of the iron core 1. Although the details are explained later, the armature 6 is attracted or repelled by the magnetic pole portions 1*a*, 1*b* according to energization of the coil 3 to obtain a driving force for driving contacts 14*a*, 14*b*. The armature 6 is provided with supported portions 6*d* on opposite sides of the central portion thereof that are swingingly supported by respective support portions 12*a* of a subbase block 60 explained later.

7 denotes an armature spring (drive member) made of a flat and metallic spring material and having a central piece 7*a* and opposite leg pieces 7*b*. The armature spring 7 is generally formed into an inversed figure of "U" as viewed laterally. The armature spring 7 together with the armature 6 constitutes an armature block 40 with the central piece 7*a* joined to a central portion of the other surface of the armature 6. Distal end portions of the leg pieces 7*b* of the armature spring 7 are brought into contact with transmitting portions 8*a* of hinged springs 8, which are explained later and above which they are placed, to transmit the driving force obtained by the armature 6 to the transmitting portions 8*a*.

The distal end portions of the leg pieces 7*b* of the armature spring 7 are positioned to the central fulcrum 6*c* rather than below the opposite end portions of the armature 6, making it possible to transmit the aforementioned driving force to the transmitting portions 8*a* positioned to the fulcrum 6*c* rather than below the opposite end portions of the armature 6.

8 denotes a hinged spring (transit member) having a proximal end pivotally supported by a hinge pin 9 that is supported by a support portion 12*b* formed with an insulator 12 explained later. The hinged spring 8 is provided with a convex transmitting portion 8*a* which is brought into contact with the armature spring 7 for the transmission of the driving force. A distal end portion of the hinged spring 8 is held in contact with a connector plate 10*b* of a support member 10 explained later to transmit thereto the driving force obtained by the armature 6.

The distal end portion of the hinged spring 8 is positioned closer to the fulcrum 6*c* than the transmitting portion 8*a* as viewed from above, making it possible to transmit the aforementioned driving force to the connector plate 10*b* that is positioned closer to the fulcrum 6*c* than the transmitting portion 8*a*. The hinged spring 8 together with the hinge pin 9 constitutes a hinged plate block 50.

10 denotes a support member that is constituted by a return spring 10*a* and a connector plate (support portion) 10*b* fixed to the top of the return spring 10*a*. The return spring 10*a* has opposite leg portions on respective sides of the top thereof and is generally formed into an inversed figure of "V" as viewed laterally.

The return spring 10*a* is made of a flat and metallic spring material and has insertion holes 10*c* formed in the leg portions through which respective contact support members 13 extend, which are explained later. The return spring 10*a* electrically connects the connector plate 10*b* to the subbase 11 with distal end portions of the leg portions placed on the subbase 11 and positioned with respect to the insulator 12 integrally formed with the subbase 11.

The connector plate 10*b* has rectangular support holes 10*d* formed in opposite end portions thereof to support respective contact support members 13 extending therethrough. The driving force is transmitted from the hinged spring 10*a* to a portion of the connector plate 10*b* that is located inside the support holes 10*d*. The connector plate 10*b* has shielding portions 10*e* formed around the support holes 10*d* at locations corresponding to portions around insertion holes 11*a* of the subbase 11.

11 denotes a subbase (first shielding member) made of a metallic plate that constitutes a subbase block 60 together with the insulator 12 made of a resinous material and integrally formed therewith. The subbase 11 has opposite end portions in the longitudinal direction thereof to support the end portions 2 of the electromagnet block 30 placed thereon, and also has coil terminal insertion holes (not shown) formed therein at locations close to the four corners thereof, through which coil terminals 4*b* to be connected to the aforementioned coil terminals 4*a* extend in a state of being insulated by the insulator 12. The subbase 11 has insertion holes 11*a* defined therein at four locations close to the central portion thereof so that stationary portions 13*b* of the contact support members 13 extend through the insertion holes 11*a*.

The insulator 12 has support portions 12*a* formed on opposite sides of the central portion in the longitudinal direction thereof to swingingly support the supported portions 6*d* of the armature 6, and also has support portions 12*b* formed on the centers of the end portions in the longitudinal direction thereof to rotatably support the hinge pins 9.

13 denotes contact support members made of a resinous material and each having a rectangular parallelepiped-shaped base portion 13*a* and a rectangular parallelepiped-shaped stationary portion 13*b* smaller than the base portion 13*a*. Each stationary portion 13*b* extends through and is supported by the support hole 10*d* of the connector plate 10*b* under the condition in which it extends through the insertion hole 11*a* of the subbase 11 and through the insertion hole 10*c* of the return spring 10*a*.

Two of the contact support members 13 are disposed side by side and other two contact support members 13 are also disposed side by side in the widthwise direction of a base 15 explained later with the contacts 14*a*, 14*b* extending through and held by the associated contact support members 13, so that the high frequency relay according to the present invention can be used as a so-called double-pole high frequency relay.

14*a* and 14*b* denote generally flat contacts extending through and held by the base portions 13*a* of the associated contact support members 13 to constitute a contact block 70 together with the contact support members 13. These contacts 14*a*, 14*b* have respective contact surfaces 14*c* that are brought into contact with or separated from three kinds of stationary terminals explained later, i.e., normally-closed stationary terminals 17, normally open stationary terminals 18, and common stationary terminals 19. The contact surfaces 14*c* are substantially in parallel with an external bottom surface of the base 15, i.e., a mounting surface 15*b* under the condition in which the contacts 14*a*, 14*b* extend through and held by the base portions 13*a* of the contact support members 13.

15 denotes a base (second shielding member) formed into a predetermined boxed-shaped shallow and rectangular configuration by metal-injection molding. The base 15 has insulators 16 made of a resinous material and integrally formed therewith at opposite end portions and on opposite sides of a central portion in the longitudinal direction thereof. The base 15 together with the insulators 16 constitutes a base block 80. The base 15 has recesses 15*a* defined therein at locations close to the four corners thereof, through which the coil terminals 4*b* pass. The external bottom surface of the base 15 is used as a mounting surface 15*b* when the high frequency relay according to the present invention is mounted on, for example, a printed wiring board (outside). The high frequency relay can be grounded by properly grounding a surface of the printed wiring board on which it is mounted.

Furthermore, the base 15 together with the subbase 11 constitutes a shielding assembly S by bringing the subbase 11 into close contact with the upper surface of the base 15 in a direction perpendicular to the contact surfaces 14*c* of the contacts 14*a*, 14*b* and joining them together by laser welding. The shielding assembly S shields contact portions between the three kinds of stationary terminals 17, 18, 19 and the contacts 14*a*, 14*b* with the contacts 14*a*, 14*b* sandwiched between the constituent elements, i.e., the subbase 11 and the base 15 in the direction perpendicular to the contact surfaces 14*c*.

17 denotes a normally-closed stationary terminal extending through and held by the insulator 16 that is integrally formed with an end portion of the base 15 in the longitudinal direction thereof. The normally-closed stationary terminal 17 extends outwardly from the base 15 and has an inner end portion positioned in the proximity of an end portion of the armature 6 as viewed from above so as to confront one of the contacts 14*a* so that it may be brought into contact with or separated from the one contact 14*a* for opening or closing the normally-closed side. The normally-closed stationary terminal 17 is bent at an intermediate portion thereof so that an outer end portion thereof may be substantially flush with the external bottom surface of the base 15, i.e., the mounting surface 15*b*.

18 denotes a normally open stationary terminal extending through and held by the insulator 16 that is integrally formed with the other end portion of the base 15 in the longitudinal direction thereof. The normally open stationary terminal 18 extends outwardly from the base 15 and has an inner end portion positioned in the proximity of the other end portion of the armature 6 as viewed from above so as to confront one of the contacts 14*b* so that it may be brought into contact with or separated from the one contact 14*b* for opening or closing the normally open side. The normally open stationary terminal 18 is bent at an intermediate portion thereof so that an outer end portion thereof may be substantially flush with the external bottom surface of the base 15, i.e., the mounting surface 15*b*.

19 denotes a common stationary terminal extending through and held by the insulator 16 that is integrally formed with a central portion of the base 15 in the longitudinal direction thereof. The common stationary terminal 17 extends outwardly from the base 15 and has an inner end portion positioned in the proximity of a central portion of the armature 6, i.e. the fulcrum 6*c* as viewed from above so as to confront one of the contacts 14*a*, 14*b* so that it may be brought into contact with or separated from the one contact 14*a*. The common stationary terminal 19 is bent at an intermediate portion thereof so that an outer end portion thereof may be substantially flush with the external bottom surface of the base 15, i.e., the mounting surface 15*b*.

20 denotes a box-shaped metallic casing covered on the base 15 to form outer surfaces of the high frequency relay together with the external bottom surface of the base 15, i.e. the mounting surface 15*b*. The casing 20 has notches 20*a* defined in the open edges thereof to allow the stationary terminals 17, 18, 19 to pass therethrough.

The casing 20 has an upper wall held in contact with the end portions 2 of the iron core 1 so that the electromagnet block 30, the subbase block 60 and the like may be positioned between the upper wall and the base 15. The casing 20 and the base 15 are sealed by a sealant (not shown).

The high frequency relay according to the present invention operates as follows. When the coil 3 is energized with electricity, one end portion 6*a* of the armature 6 is attracted to the magnetic pole portion 1*a* at one end of the iron core 1 so that the armature 6 provides a swinging motion or seesaw motion with the convex fulcrum 6*c* held in contact with the central portion of the permanent magnet 5.

As a result, the armature spring 7 integrated with the armature 6 also swings, and the leg piece 7*b* of the armature spring 7 presses the transmitting portion 8*a* of the associated hinged spring 8 positioned close to one end of the base 15 in the longitudinal direction thereof, thereby transmitting thereto a driving force from the armature 6. The hinged spring 8, to which the driving force has been transmitted, swings and presses the connector plate 10*b* of the associated support member 10 and depresses the return spring 10*a* fixed to the connector plate 10*b*, thereby moving the contact support member 13, which extends through and held by the support hole 10*d* of the connector plate 10*b*, toward the base 15.

Figure 5:
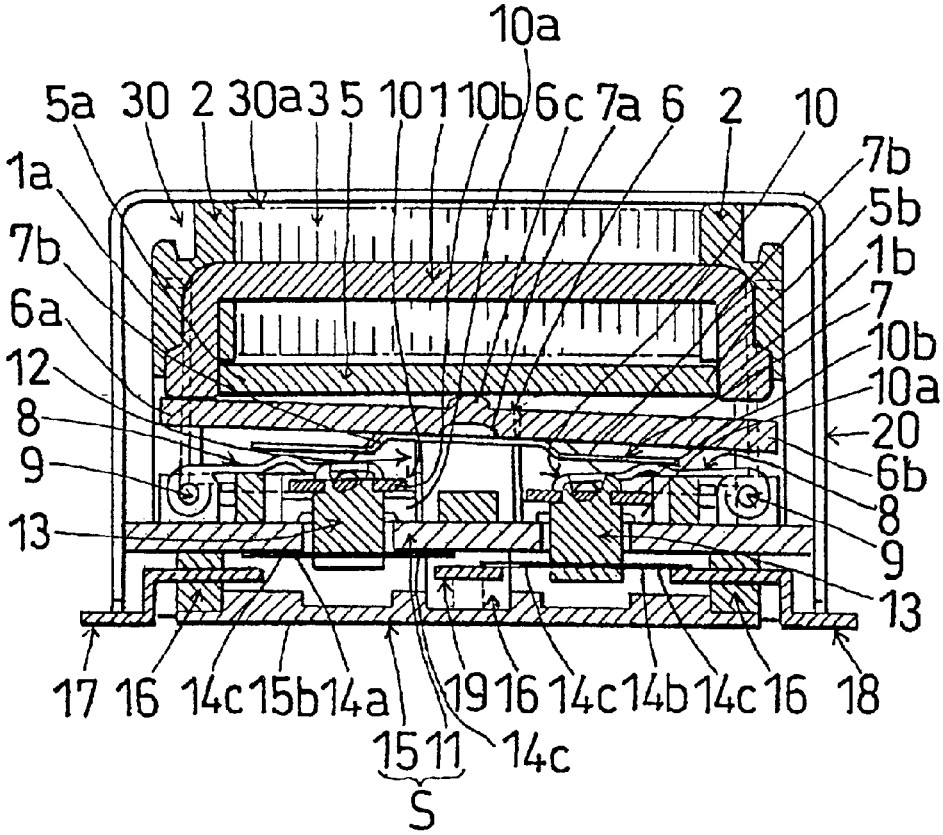
FIG. 5 is a vertical sectional view of the high frequency relay of FIG. 4.

As a result, the contact 14*b* extending through and held by the contact support member 13 is also moved toward the base 15 from a state in which it has been held in contact with the subbase 11 until then, and the contact surface 14*c* thereof is brought into contact with the normally open stationary terminal 18 and the common stationary terminal 19. This state is depicted in FIG. 5.

At this moment, when the coil 3 is deenergized, the end 6*a* of the armature 6 is separated from the magnetic pole portion 1*a* at one end of the iron core 1, while the other end 6*b* of the armature 6 is attracted to the magnetic pole portion 1*b* at the other end of the iron core 1, resulting in reversal swinging.

As a result, the armature spring 7 integrated with the armature 6 also swings reversely, and the leg piece 7*b* of the armature spring 7 presses the transmitting portion 8*a* of the associated hinged spring 8 positioned close to the other end of the base 15 in the longitudinal direction thereof, thereby transmitting thereto a driving force from the armature 6. The hinged spring 8, to which the driving force has been transmitted, swings and presses the connector plate 10*b* of the associated support member 10 and depresses the return spring 10*a* fixed to the connector plate 10*b*, thereby moving the contact support member 13, which extends through and held by the support hole 10*d* of the connector plate 10*b*, toward the base 15.

At this moment, the return spring 10*a* that has been depressed until then deflects and returns to its original shape by means of its own spring force. This return spring 10*a* moves the contact support member 13, which extends through and is held by the support hole 10*d* of the connector plate 10*b*, away from the base 15.

As a result, the contact 14*a* extending through and held by the contact support member 13, which has moved toward the base 15, is also moved toward the base 15 from a state in which it has been held in contact with the subbase 11 until then, and the contact surface 14*c* thereof is brought into contact with the normally-closed stationary terminal 17 and the common stationary terminal 19. Furthermore, the contact 14*b* extending through and held by the contact support member 13, which has moved away from the base 15, also moves away from the base 5 and is brought into contact with the subbase 11.

In the high frequency relay discussed above, the stationary terminals 17, 18, 19 substantially flush with the mounting surface 15*b* to be mounted on a printed wiring board can be used as the so-called SMD terminals and soldered to the surface of the printed wiring board. Accordingly, compared with conventional relays in which the stationary terminals extend through the printed wiring board so as to protrude beyond the rear surface thereof, the stationary terminals 17, 18, 19 forming transmission paths for high frequency signals can be shortened, making it possible to enhance the shielding properties with respect to the transmission paths for the high frequency signals.

Furthermore, because the contacts 14*a*, 14*b* are supported in an insulated state so that the contact surfaces 14*c* thereof may extend in parallel with the mounting surface 15*b*, the stationary terminals 17, 18, 19 forming the transmission paths for the high frequency signals can be shortened by a length corresponding to the width of the contacts 14*a*, 14*b* at the contact surfaces 14*c*, compared with the case where the contact portions of the stationary terminals with the contacts extend in a direction perpendicular to the mounting surface and the surfaces of the contacts similarly extend in the same direction, making it possible to enhance the shielding properties with respect to the transmission paths for the high frequency signals.

In addition, because the driving force from the armature 6 is transmitted to the portions inwardly of the opposite end portions of the armature 6 by the armature spring 6 integrated with the armature 6, the transmitting portions 8*a* of the hinged springs 8 to which the driving force for driving the contacts 14*a*, 14*b* is transmitted can be positioned close to the common stationary terminals 19, compared with the case where the driving force is transmitted to portions close to the magnetic pole portions at the opposite ends. Accordingly, it becomes possible to contact or separate the contacts 14*a*, 14*b* with or from the common stationary terminals 19, without increasing the size of the contacts 14*a*, 14*b* in a direction along the armature 6. Because it is not necessary to increase the size of the contacts 14*a*, 14*b*, which come to be the transmission paths for the high frequency signals, in the direction along the armature 6, making it possible to further enhance the shielding properties with respect to the transmission paths for the high frequency signals.

Also, because the hinged springs 8 transmit the transmitted driving force to the portions close to the fulcrum 6*c* inwardly of the transmitting portions 8*a* to which the driving force for driving the contacts 14*a*, 14*b* is transmitted, the connector plates 10*b* through which the driving force is transmitted can be positioned close to the common stationary terminals 19, making it possible to enhance the shielding properties with respect to the transmission paths for the high frequency signals.

Moreover, because the shielding assembly S is provided to sandwich the contacts 14*a*, 14*b* in a direction perpendicular to the contact surfaces 14*c*, i.e. in a direction perpendicular to the mounting surface 15*b*, the contacts 14*a*, 14*b* can be arranged in two rows in the widthwise direction of the mounting surface 15*b*. Accordingly, it is not necessary to provide the shielding assembly S for every pole, and the shielding assembly S can be used for double-pole relays.

Also, because the contacts 14*a*, 14*b* are caused to move in a direction perpendicular to the mounting surface 15*b*, it is sufficient if the space required for movement of the contacts 14*a*, 14*b* has a height allowing the contacts 14*a*, 14*b* to move along the direction perpendicular to the mounting surface 15*b*. However, in the case where the contacts 14*a*, 14*b* are caused to move in a direction parallel to the mounting surface 15*b*, a space of a height corresponding to the width of the contacts 14*a*, 14*b* must be secured for the movement of the contacts 14*a*, 14*b*. Accordingly, the high frequency relay according to the present invention can have a reduced size.

Furthermore, because the contact portions between the contacts 14*a*, 14*b* and the stationary terminals 17,18, 19, and the coil terminals 4*a*, 4*b* are shielded not only by the shielding assembly S but also by the metallic casing 20, the shielding properties can be enhanced.

In addition, although the subbase 11 constituting the shielding assembly S has the insertion holes 11*a* for insertion of the contact support members 13, the support members 10 have the metallic shielding portions 10*e* at locations corresponding to the portions around the insertion holes 11*a* of the subbase 11 and, hence, the contacts 14*a*, 14*b* can be shielded by such shielding portions 10*e*, enhancing the shielding properties.

Also, because the connector plates 10*b* for supporting the contact support members 13 that in turn support respective contacts 14*a*, 14*b* are made of a metal and electrically connected to the subbase 11 constituting the shielding assembly S by the return springs 10*a*, the contacts 14*a*, 14*b* can be shielded at locations supporting the contact support members 13 of an insulating material, enhancing the shielding properties.

Furthermore, because the external surface of the base 15 constituting the shielding assembly S is used as the mounting surface 15*b*, the shielding assembly S can be grounded merely by mounting it on a printed wiring board without providing any separate earth terminal. In addition, the use of the whole mounting surface 15*b* for the grounding sufficiently ensures the grounding.

Also, metal-injection molding allows the base 15 constituting the shielding assembly S to be readily formed into a desired shape and also enables precise processing, making it possible to reduce the size and, in particular, the height of the high frequency relay.

Furthermore, laser welding ensures the connection between the subbase 11 and the base 15, providing sufficient shielding properties.

Figure 6:
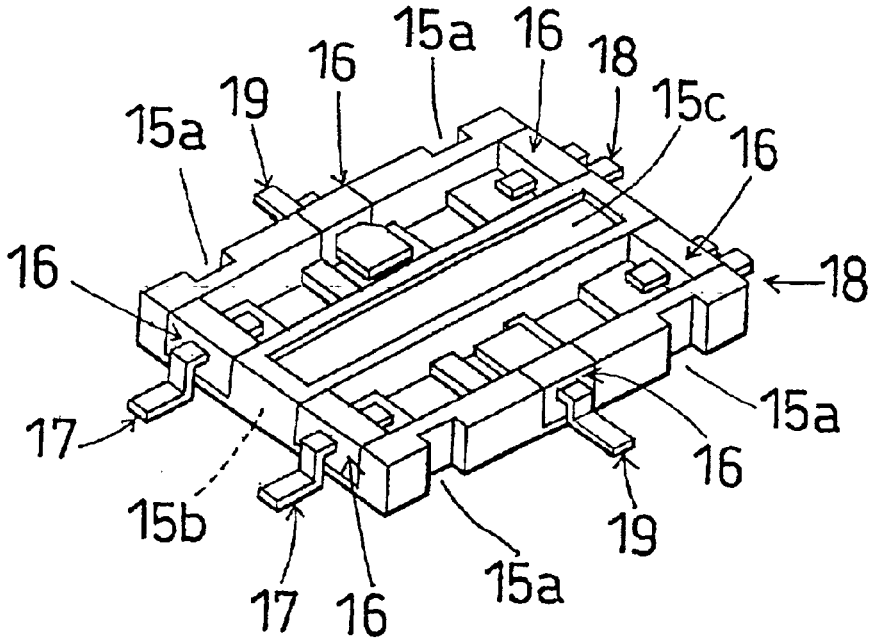
FIG. 6 is a perspective view of a base of a high frequency relay according to a second embodiment of the present invention.

A high frequency relay according to a second embodiment of the present invention is explained hereinafter with reference to FIGS. 6 and 7.

Although the high frequency relay according to this embodiment is substantially the same as the high frequency relay according to the first embodiment, the subbase 11 and the base 15, both constituting the shielding assembly S, are joined together not only by laser welding but also by an electrically conductive adhesive.

The base 15 has a recess 15*c* defined in a central portion thereof along the longitudinal direction in which the adhesive is stored. The base 15 is joined to the subbase 11 by the electrically conductive adhesive stored in the recess 15*c*.

Figure 7:
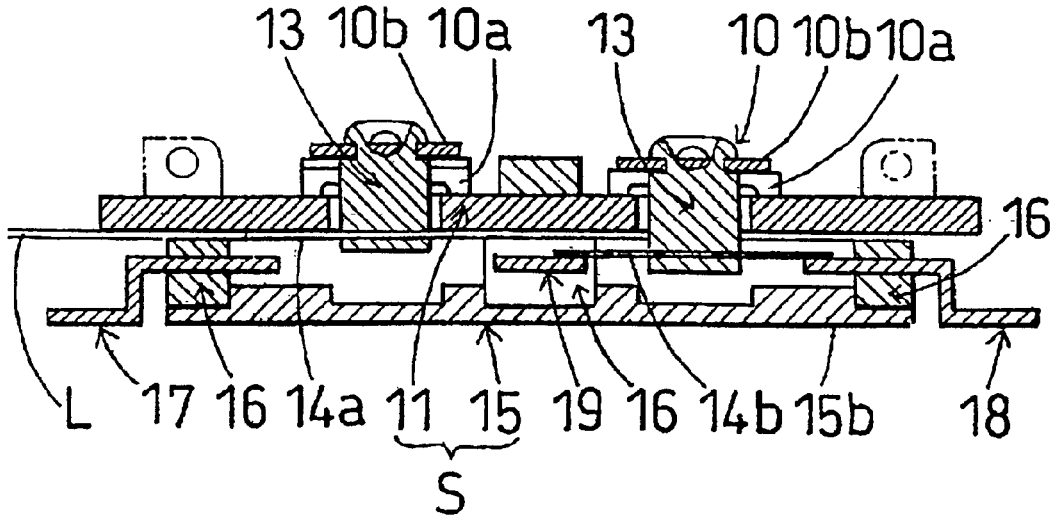
FIG. 7 is a partial sectional view illustrating a state in which a gap is created between the base and a subbase.

In addition to the effects of the high frequency relay according to the first embodiment, this high frequency relay is advantageous in that because the subbase 11 and the base 15 are joined together by the electrically conductive adhesive, even if a gap L as shown in FIG. 7 is created between the subbase 11 and the base 15 due to, for example, a dimensional tolerance, the electrical connection between the subbase 11 and the base 15 is ensured, making it possible to maintain the shielding properties.

Figure 8:
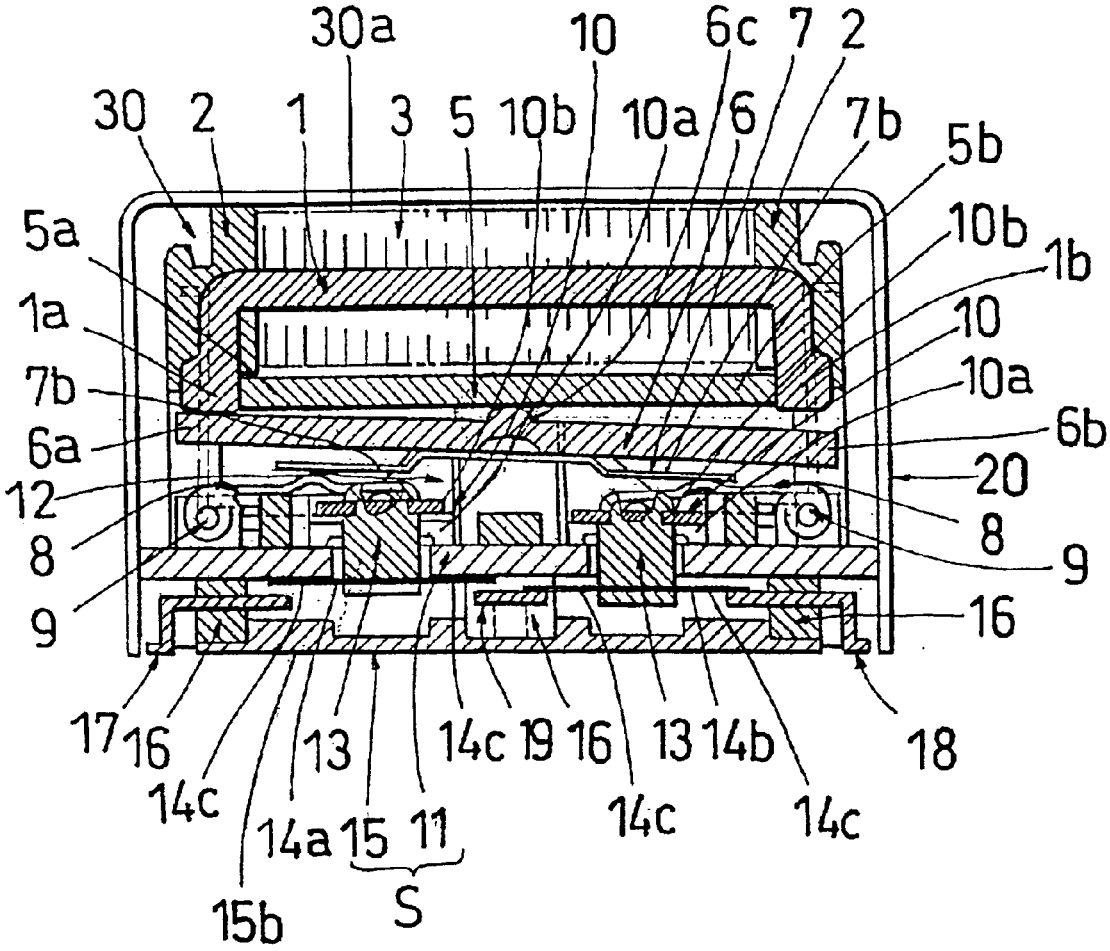
FIG. 8 is a vertical sectional view of a high frequency relay according to a third embodiment of the present invention.
Figure 9:
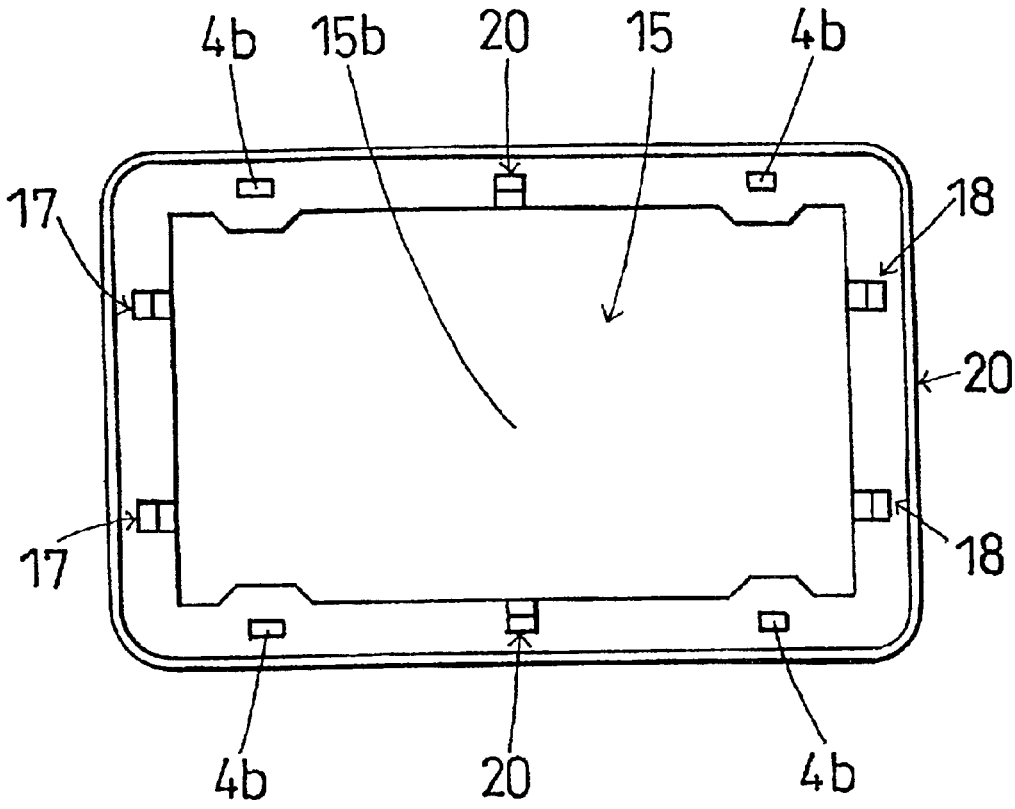
FIG. 9 is a bottom plan view of the high frequency relay of FIG. 8.
Figure 10:
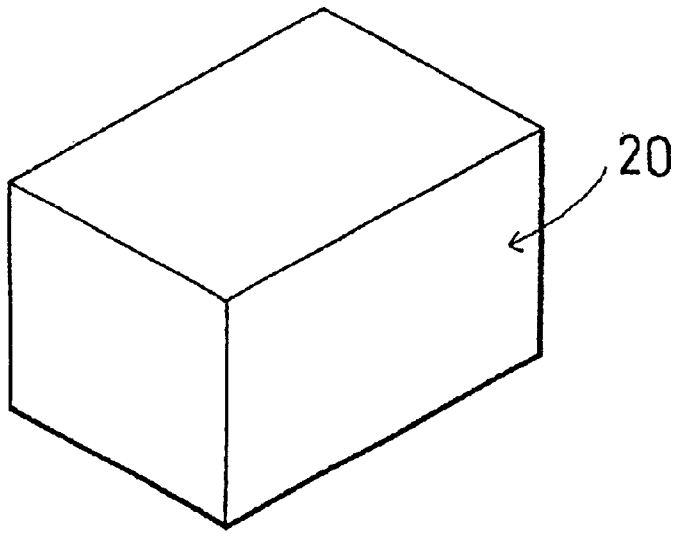
FIG. 10 is a perspective view of the high frequency relay of FIG. 8.
Figure 11:
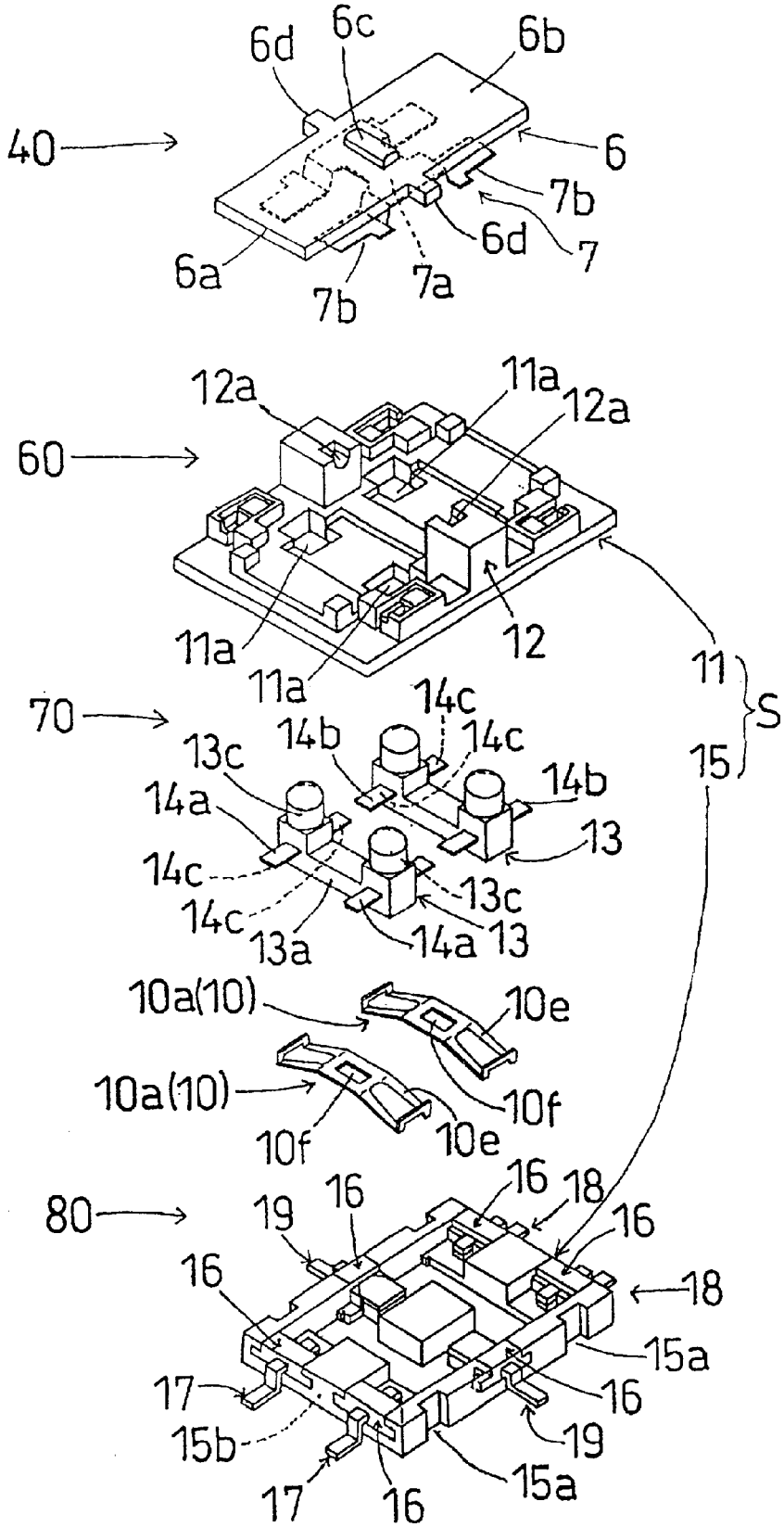
FIG. 11 is an exploded perspective view of a high frequency relay according to a fourth embodiment of the present invention with a casing and an electromagnet block removed.
Figure 12:
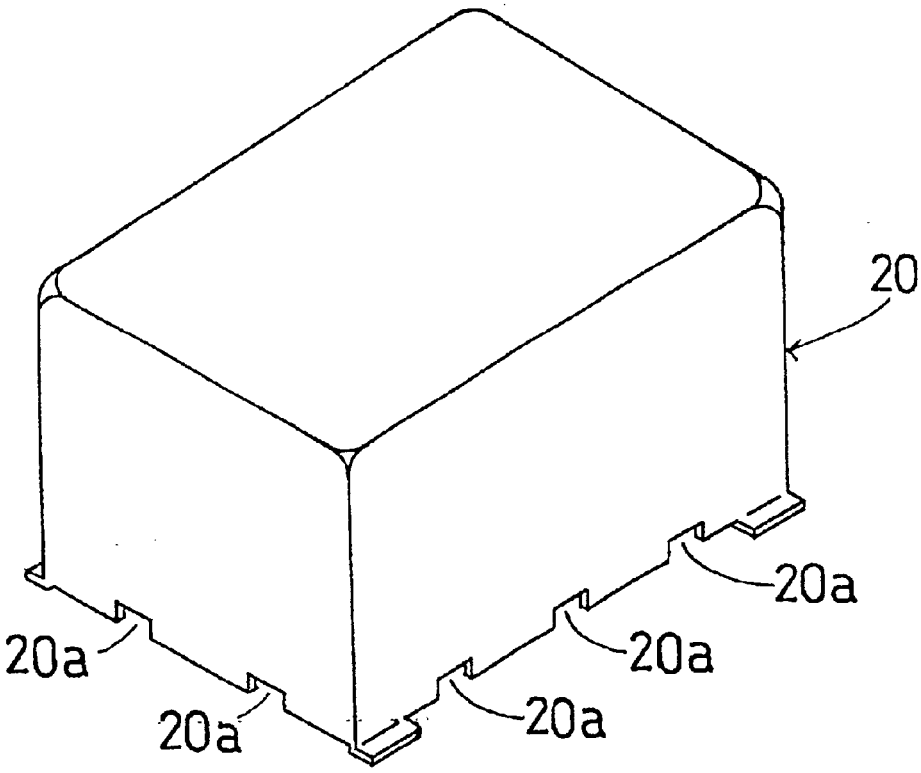
FIG. 12 is a perspective view of the casing attached to the high frequency relay.

A high frequency relay according to a third embodiment of the present invention is explained hereinafter with reference to FIGS. 8 to 10.

Although the high frequency relay according to this embodiment is substantially the same as the high frequency relay according to the second embodiment, distal end portions of the stationary terminals 17, 18, 19 are positioned inside the casing as viewed from the direction perpendicular to the mounting surface 15*b*.

In addition to the effects of the high frequency relay according to the second embodiment, this high frequency relay is advantageous in that because the distal end portions of the stationary terminals 17, 18, 19 are positioned inside the casing 20 as viewed from the direction perpendicular to the mounting surface 15*b*, the stationary terminals 17, 18, 19 do not protrude outwardly from the casing 20, making it possible to enhance the shielding properties with respect to the transmission paths for the high frequency signals.

A high frequency relay according to a fourth embodiment of the present invention is explained hereinafter with reference to FIGS. 11 to 14.

Although the high frequency relay according to this embodiment is substantially the same as the high frequency relay according to the first embodiment, the coil terminals 4 integrally molded with the end portions of the iron core are directly led outside. Furthermore, neither the hinged springs 8 nor the hinge pins 9 are provided, and each support member 10 consists of only the return spring 10*a*, resulting in a reduction in the number of component parts.

Figure 13:
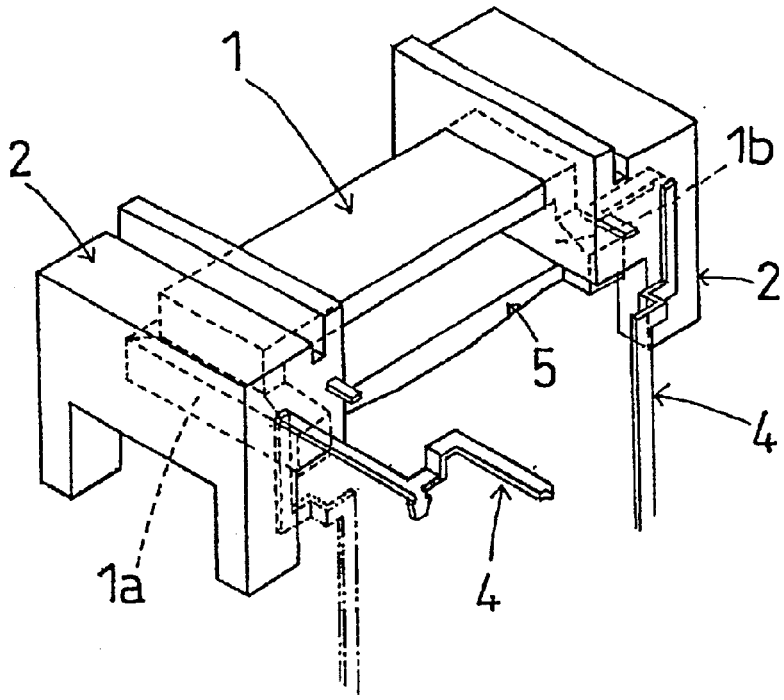
FIG. 13 is a perspective view of the electromagnet block attached to the high frequency relay.

The coil terminals 4 protrude outwardly from the end portions 2 of the iron core integrally molded therewith and are bent at the roots of the protruding portions so as to extend along the end portions 2, as shown in FIG. 13.

Each return spring 10*a* has a central piece and opposite leg portions and is generally formed into an inversed figure of "V" as viewed laterally. The return spring 10*a* is a support member having a support hole 10*f* defined in the central piece for supporting a contact support member 13 explained later such that a projection (not shown) formed on the rear surface of the contact support member 13 extends through and is held by the support hole 10*f*. The return spring 10*a* is electrically connected to the base 15 with distal end portions of the leg portions placed on the base 15 and positioned with respect to inner walls of the base 15. Outer edges of both the leg portions of the return spring 10*a* constitute shielding portions 10*e* disposed at locations around the associated insertion hole 11*a* of the subbase 11.

The contact support member 13 is formed into a figure of "U" and has integrated base portions 13*a* disposed on respective sides of the mounting surface 15*b* in the widthwise direction thereof and generally cylindrical contact portions 13*c* integrally formed with the base portions 13*a*. The contacts 14*a*, 14*b* extend through and are held by the base portions 13*a*, respectively. The contact portions 13*c* have respective generally hemispherical top ends with which the leg pieces 7*b* of the armature spring 7 are brought into contact. The contact support member 13 receives a driving force from the armature 6 when the leg pieces 7*b* of the armature spring 7 are brought into contact with the contact portions 13*c*.

The operation of the high frequency relay of the above-described construction is explained hereinafter. The operation similar to that of the high frequency relay according to the first embodiment is briefly explained.

When the coil 3 is energized with electricity, the armature 6 swings and the armature spring 7 integrated with the armature 6 also swings. The leg pieces 7*b* of the swinging armature spring 7 are brought into contact with the contact portions 13*c* of the contact support member 13 positioned close to one end of the base 15 in the longitudinal direction thereof, and deflect the leg portions of the return spring 10*a* supporting the contact support member 13, thereby moving the contact support member 13 toward the base 15.

Figure 14:
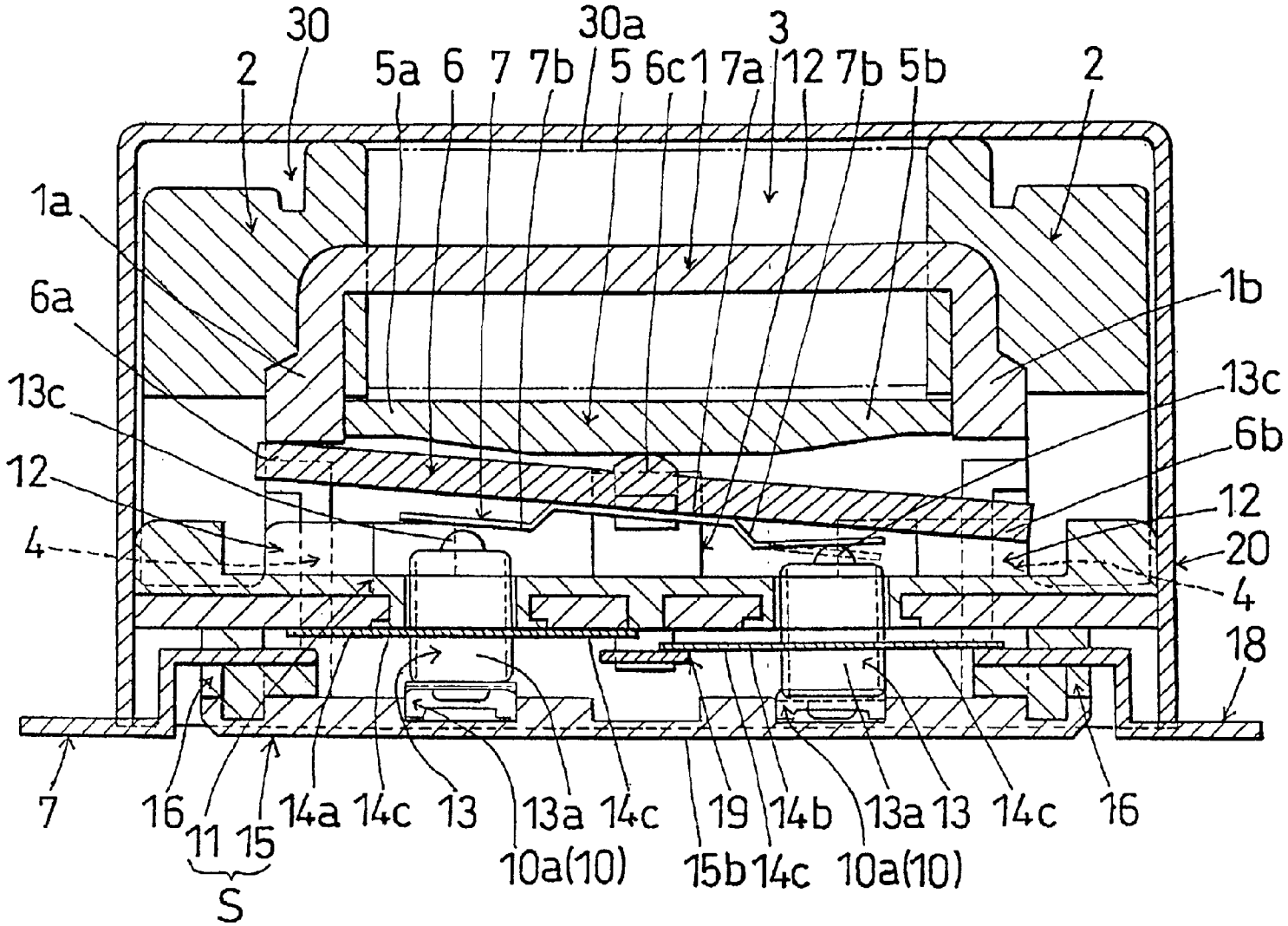
FIG. 14 is a vertical sectional view of the high frequency relay.

As a result, the contacts 14*b* extending through and held by the contact support member 13 are also moved toward the base 15 from a state in which they have been held in contact with the subbase 11 until then, and the contact surfaces 14*c* thereof are brought into contact with the normally open stationary terminals 18 and the common stationary terminals 19. This state is depicted in FIG. 14.

At this moment, when the coil 3 is deenergized, the armature 6 swings reversely and the armature spring 7 integrated with the armature 6 also swings reversely. Then, the leg pieces 7*b* of the armature spring 7 are brought into contact with the contact portions 13*c* of the contact support member 13 positioned close to the other end of the base 15 in the longitudinal direction thereof, and deflect the leg portions of the return spring 10*a* supporting the contact support member 13, thereby moving the contact support member 13 toward the base 15.

At this moment, the return spring 10*a* that has been depressed until then deflects and returns to its original shape by means of its own spring force. This return spring 10*a* moves the contact support member 13 supported thereby away from the base 15.

As a result, the contacts 14*a* extending through and held by the contact support member 13, which has moved toward the base 15, are also moved toward the base 15 from a state in which they have been held in contact with the subbase 11 until then, and the contact surfaces 14*c* thereof are brought into contact with the normally-closed stationary terminals 17 and the common stationary terminals 19. Furthermore, the contacts 14*b* extending through and held by the contact support member 13, which has moved away from the base 15, also move away from the base 5 and are brought into contact with the subbase 11.

In the high frequency relay discussed above, the stationary terminals 17, 18,19 can be used as the so-called SMD terminals and soldered to the surface of a printed wiring board, as is the case with the high frequency relay according to the first embodiment. Because the contacts 14*a*, 14*b* are supported in an insulated state so that the contact surfaces 14*c* thereof may extend in parallel with the mounting surface 15*b*, and because the driving force is transmitted to the portions inwardly of the opposite end portions of the armature 6 by the armature spring 7 integrated with the armature 6, the shielding properties with respect to the transmission paths for the high frequency signals can be enhanced.

Furthermore, it is not necessary to provide the shielding assembly S for every pole, and it can be used for double-pole relays. Also, the high frequency relay according to the present invention can have a reduced size. In addition, the metallic casing 20 provides the shielding properties, and the support members 10 have respective metallic shielding portions 10*e* at locations corresponding to the portions around the insertion holes 11*a* of the subbase 11, making it possible to enhance the shielding properties.

Also, because the return springs 10*a* for supporting the contact support members 13 that in turn support the contacts 14*a*, 14*b* are made of a metallic material and electrically connected at the leg portions thereof to the base 15 constituting the shielding assembly S, the contacts 14*a*, 14*b* can be shielded at locations supporting the contact support members 13 of an insulating material, enhancing the shielding properties.

Furthermore, because the external surface of the base 15 is used as the mounting surface 15*b*, sufficient ground can-be achieved. Also, metal-injection molding allows the base 15 to be readily formed into a desired shape, making it possible to reduce the size and, in particular, the height of the high frequency relay.

In addition, laser welding ensures the connection between the subbase 11 and the base 15, providing sufficient shielding properties.

Compared with the high frequency relay according to the first embodiment, the number of the component parts is reduced, and because there are not any rotating elements such as the hinged springs 8 or the hinge pins 9, any friction following the rotation does not occur, making it possible to further stabilize the operation.

As is the case with the high frequency relay according to the second embodiment, the high frequency relay according to this embodiment may employ both the laser welding and an electrically conductive adhesive to join the subbase 11 and the base 15. In this case, even if a gap L as shown in FIG. 7 is created between the subbase 11 and the base 15, the electrical connection between the subbase 11 and the base 15 is ensured, making it possible to maintain the shielding properties.

Moreover, as is the case with the high frequency relay according to the third embodiment, the high frequency relay according to this embodiment may employ the stationary terminals 17, 18, 19 having distal end portions positioned inside the casing as viewed from the direction perpendicular to the mounting surface 15*b*. In this case, the stationary terminals 17, 18, 19 do not protrude outwardly beyond the casing 20, thus enhancing the shielding properties with respect to the transmission paths for the high frequency signals.

In the first to fourth embodiments discussed above, four kinds of terminals, i.e., the coil terminals 4, normally-closed stationary terminals 17, normally open stationary terminals 18, and common stationary terminals 19 are arranged around the base 15 such that as viewed from above, the common stationary terminals 19 are led outwardly between the locations where the normally-closed stationary terminals 17 and the normally open stationary terminals 18 are led outwardly, and the coil terminals 4 are led outwardly between the locations where the normally-closed stationary terminals 17 and the common stationary terminals 19 are led outwardly and between the locations where the normally open stationary terminals 18 and the common stationary terminals 19 are led outwardly.

Figure 15:
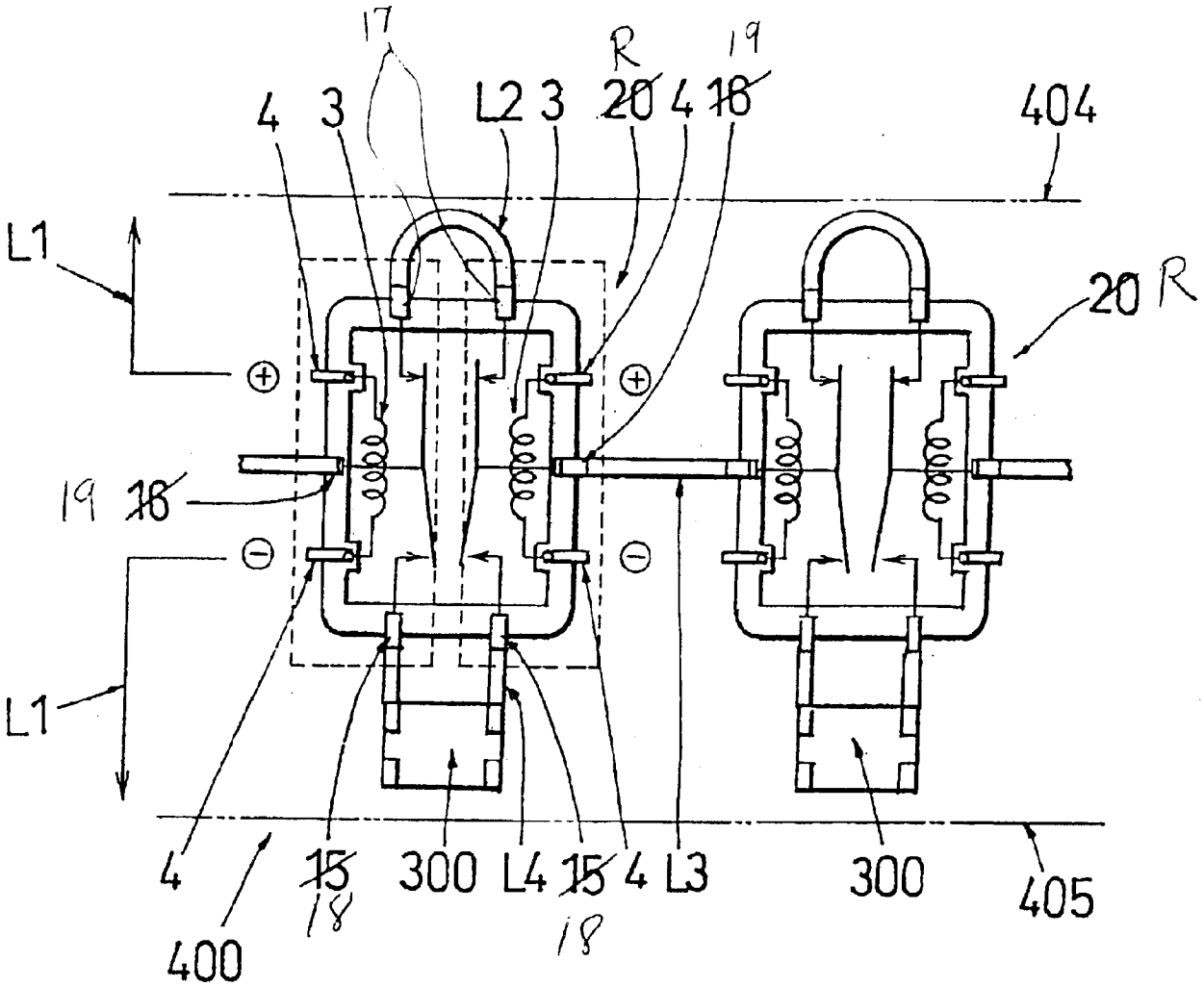
FIG. 15 is a schematic circuit diagram when an attenuator circuit is constituted by the high frequency relay according to the present invention together with an attenuator element.
Figure 16:
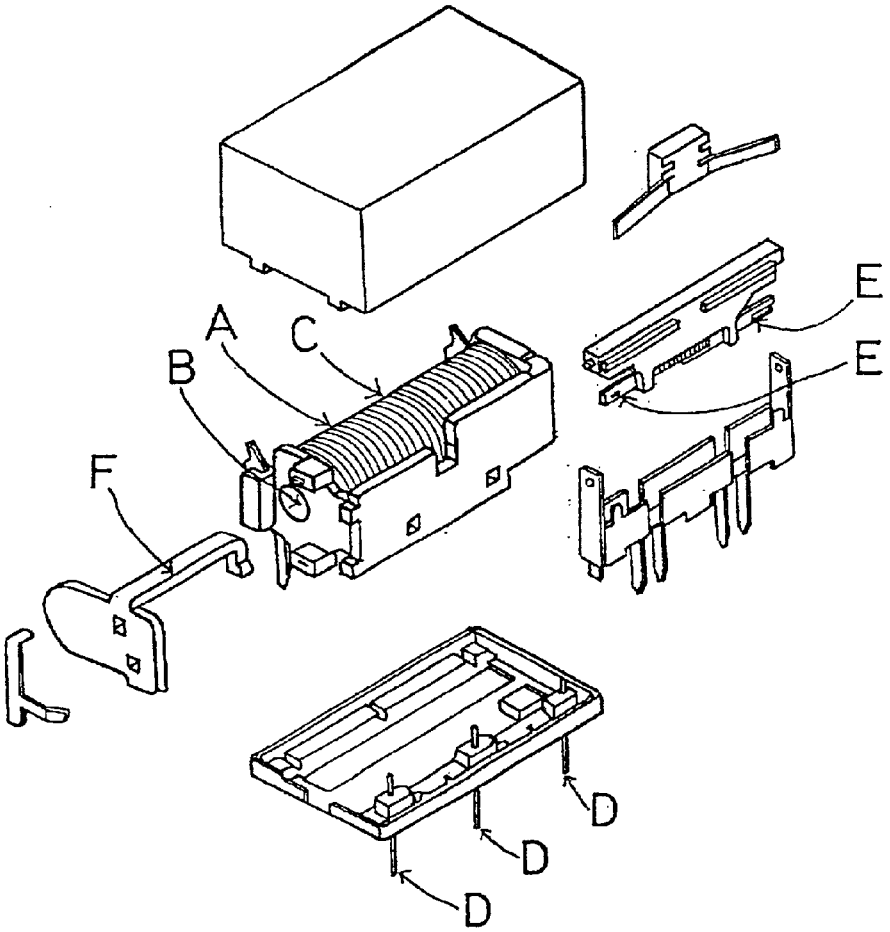
FIG. 16 is an exploded perspective view of a conventional high frequency relay.
Figure 17:
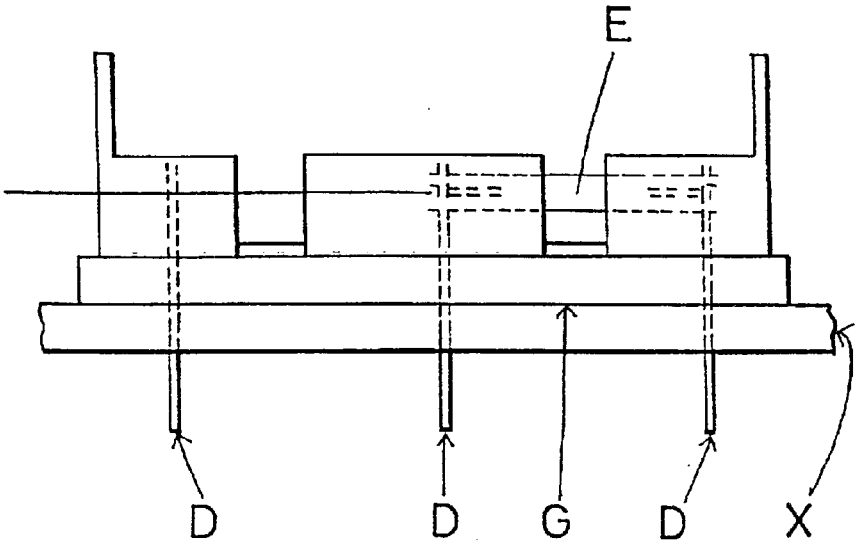
FIG. 17 is a partial front view illustrating a state in which the high frequency relay of FIG. 16 is mounted on a printed wiring board.

As shown in FIG. 15, the high frequency relays referred to above are used together with an attenuator element 300 to constitute an attenuator circuit for attenuating a signal strength by a required amount without producing any distortion. In this case, the high frequency relay R is soldered to a printed wiring board 400 of a microstrip structure. The microstrip structure is a structure sandwiching a dielectric substance between transmission paths on the front side of the printed wiring board and a grounding member on the rear side, and is effective to achieve impedance matching for high frequency signals.

In this high frequency relay R, the normally-closed stationary terminals 17, 17 are connected to each other via a transmission path L2 of the printed wiring board 400 of the microstrip structure, while the normally open stationary terminals 18, 18 are connected to each other via a transmission path L4 of the printed wiring board 400 and via the attenuator element 300. Furthermore, the common terminal 19 and a common terminal 19 of the neighboring high frequency relay R are connected to each other via a transmission path L3 of the printed wiring board 400.

Also, in the high frequency relay R, the coil terminals 4 adjacent to one end of the base 15 in the longitudinal direction thereof are connected to a plus-side supply line 404 on the printed wiring board 400 via a transmission path L1 of the printed wiring board 400, while the coil terminals 4 adjacent to the other end of the base 15 in the longitudinal direction thereof are connected to a minus-side supply line 405 on the printed wiring board 400.

The operation of the attenuator circuit employing the high frequency relay shown in FIGS. 11 to 14 as the high frequency relay R is explained hereinafter.

When the coil 3 is energized with electricity, one end 6*a* of the armature 6 is attracted by the magnetic pole portion 1*a* at one end of the iron core 1 so that the armature 6 swings with the convex fulcrum 6*c* held in contact with the central portion of the permanent magnet 5. As a result, the armature spring 7 integrated with the armature 6 also swings and is brought into contact with the contact portions 13*c* of the contact support member 13 positioned close to one end of the base 15 in the longitudinal direction thereof. The contact support member 13 of which the contact portions 13*c* have been contacted by the armature spring 7 depresses the return spring 10 and deflects it toward the base 15.

As a result, the contacts 14*b* extending through and held by the contact support member 13 are also moved toward the base 15 and are brought into contact with the normally open stationary terminals 18 and the common stationary terminals 19. Accordingly, the normally open stationary terminals 18 and the common stationary terminals 19 are connected to each other by the respective contacts 14*b* (see FIG. 14). In this state, the attenuator circuit having the high frequency relay R and the attenuator element 300 connected to each other operates to attenuate a signal strength by a required amount without producing any distortion.

At this moment, when the coil 3 is deenergized, the one end 6*a* of the armature 6 is moved away from the magnetic pole portion 1*a* at one end of the iron core 1, and the other end 6*b* of the armature 6 is attracted by the magnetic pole portion 1*b* at the other end of the iron core 1, thereby reversely swinging the armature 6. As a result, the armature spring 7 integrated with the armature 6 also swings reversely and is brought into contact with the contact portions 13*c* of the contact support member 13 positioned close to the other end of the base 15 in the longitudinal direction thereof. The contact support member 13 of which the contact portions 13*c* have been contacted by the armature spring 7 depresses the return spring 10 and deflects it toward the base 15. At this moment, the return spring 10 that has been depressed until then deflects and returns to its original shape by means of its own spring force. This return spring 10*a* moves the contact support member 13 placed thereon away from the base 15.

As a result, the contacts 14*a* extending through and held by the contact support member 13, which has moved toward the base 15, are also moved toward the base 15 and brought into contact with the normally-closed stationary terminals 17 and the common stationary terminals 19. Furthermore, the contacts 14*b* extending through and held by the contact support member 13, which has moved away from the base 15, also move away from the base 5.

Consequently, the normally-closed stationary terminals 17 and the common stationary terminals 19 are connected to each other by the contacts 14*a*, while the normally open stationary terminals 18 and the common stationary terminals 19 which have been connected by the contacts 14*b* are disconnected. In this state, the attenuator circuit does not act to attenuate the signal strength by a required amount without producing any distortion.

In such a high frequency relay R as placed on the printed wiring board 400 of the microstrip structure to constitute the attenuator circuit together with the attenuator element 300, when paying attention to the positions where the normally-closed stationary terminals 17 directly connected to each other, the normally open stationary terminals 18 connected via the attenuator element 300, and the common stationary terminals 19 are led outwardly, they are arranged around the base 15 such that as viewed from above, the common stationary terminals 19 are led outwardly between the positions where the normally-closed stationary terminals 17 and the normally open stationary terminals 18 are led outwardly, and the coil terminals 4 connected to the supply lines 404, 405 are led outwardly between the positions where the normally-closed stationary terminals 17 and the common stationary terminals 19 are led outwardly and between the positions where the normally open stationary terminals 18 and the common stationary terminals 19 are led outwardly. Accordingly, the connecting lines L1 for connecting the coil terminals 4 and the supply lines 404, 405 do not cross any one of the connecting line L2 for connecting the normally-closed stationary terminals 17, 17, the connecting line L3 for connecting the common stationary terminals 19, and the connecting line L4 for connecting the normally open stationary terminals 19, as viewed from above.

The printed wiring board 400 of the microstrip structure is, therefore, not required to have any through-holes for a multi-level crossing between the connecting lines L1, L2 and between the connecting line L1, L3 and, hence, sufficient impedance matching for high frequency signals can be obtained.

Also, because both the stationary terminals 17, 18 are separated by a length corresponding to a longitudinal size of the relay by leading out the normally-closed stationary terminals 17 from one end of the relay in the longitudinal direction thereof and the normally open stationary terminals 18 from the other end of the relay, not only can the isolation characteristics be enhanced, but the space required for the circuit arrangement can also be enlarged, making it possible to simplify the circuit designing.

Although the high frequency relay according to the above-described embodiments is a double-pole high frequency relay, the present invention is not limited to the double-pole relay. By way of example, an attenuator circuit can be constituted by juxtaposing two single-pole high frequency relays, as shown by a dotted line in FIG. 15, by directly connecting the normally-closed stationary terminals 17, 17 to each other, and by connecting the normally open stationary terminals 18, 18 via an attenuator element 300. By so doing, the same effects can be obtained.

What is claimed is:

1. A high frequency relay having a mounting surface to be mounted on an external element and comprising:

an electromagnet having an iron core and a coil wound around the iron core;

stationary terminals to be connected to the external element;

contacts formed to be generally flat and having respective contact surfaces to be selectively brought into at least one of contact with and separated from the stationary terminals;

an armature at least one of attracted to and repelled from the iron core according to energization of the coil to obtain a driving force for driving the contacts;

a pair of shielding members made of a metallic material for supporting the contacts in an insulated state so that the contact surfaces extend generally parallel to the mounting surface;

contact support members made of an insulating material for supporting the contacts and support members for supporting the contact support members to allow the contact support members to deflect in a direction perpendicular to the contact surfaces, the support members having respective metallic support portions connected to one of the pair of shielding members, wherein the pair of shielding members shield contact portions between the contacts and the stationary terminals and sandwich the contacts in a direction perpendicular to the mounting surface.

2. The high frequency relay of claim 1, wherein the stationary terminals have respective outer end portions substantially flush with the mounting surface.

3. The high frequency relay of claim 1, wherein the armature swings with a central portion thereof as a fulcrum when any one of opposite end portions thereof is one of attracted to and repelled from the iron core, wherein the armature has a first surface confronting the electromagnet and a second surface opposite to the first surface, and also has a drive member secured to the second surface thereof and having a longitudinal length shorter than that of the armature, and wherein a driving force from the armature is transmitted to the contacts via the drive member.

4. The high frequency relay of claim 3, further comprising transit members having respective transmitting portions to which the driving force is transmitted, the transmit members transmitting the driving force to locations inwardly of the transmitting portions.

5. The high frequency relay of claim 1, wherein the pair of shielding members are joined together by an electrically conductive adhesive.

6. The high frequency relay of claim 1, wherein said contact support members support said contacts in an insulated state, wherein one of the pair of shielding members has insertion holes defined therein into which the contact support members are inserted, and wherein the support members have metallic shielding portions at locations corresponding to the insertion holes.

7. The high frequency relay of claim 1, wherein the mounting surface is an external surface of one of the pair of shielding members.

8. The high frequency relay of claim 1, further comprising a casing wherein distal ends of the stationary terminals are positioned inside the casing.

9. The high frequency relay of claim 1, wherein said support members support said contacts in an insulated state wherein the contact support members support the contacts in a direction substantially parallel to the mounting surface.

10. The high frequency relay of claim 1, wherein the pair of shielding members are formed into a desired shape by metal-injection molding.

11. The high frequency relay of claim 1, wherein the pair of shielding members are joined together by laser welding.

12. The high frequency relay of claim 1, wherein the stationary terminals comprise coil terminals connected to the coil, normally-closed stationary terminals; normally open stationary terminals pairing with the normally-closed stationary terminals, common stationary terminals connectable to one of the normally-closed stationary terminals and the normally open stationary terminals, and wherein the normally-closed stationary terminal, the coil terminal, the common stationary terminal, the coil terminal, the normally open stationary terminal, the normally open stationary terminal, the coil terminal, the common stationary terminal, the coil terminal, and the normally-closed stationary terminal are arranged around one of the pair of shielding members in this order.

13. The high frequency relay of claim 12, wherein one of the pair of shielding members if formed into a rectangular configuration and wherein the normally-closed stationary terminals are led out from one side of the one of the pair of shielding members and the normally open stationary terminals are led out from the opposite side of the one of the pair of shielding members.

14. The high frequency relay according to claim 13, wherein the one side and the opposite side are opposite short sides of the one of the pair of shielding members.

* * * * *

UNITED STATES PATENT AND TRADEMARK OFFICE

CERTIFICATE OF CORRECTION

PATENT NO. : 6,806,801 B2 
DATED : October 19, 2004
INVENTOR(S) : K. Kadoya et al.

It is certified that error appears in the above-identified patent and that said Letters Patent is hereby corrected as shown below:

Title page,
Item [56], References Cited, FOREIGN PATENT DOCUMENTS, "1129650" should be -- 11219650 --; and "1130729" should be -- 11340729 --.

Signed and Sealed this

Thirty-first Day of May, 2005

JON W. DUDAS
*Director of the United States Patent and Trademark Office*